US010070723B1

(12) United States Patent
Garrity et al.

(10) Patent No.: US 10,070,723 B1
(45) Date of Patent: Sep. 11, 2018

(54) ATTACHMENT BRACKET

(71) Applicants: William Garrity, Oregon, WI (US); Troy Greenberg, Beloit, WI (US)

(72) Inventors: William Garrity, Oregon, WI (US); Troy Greenberg, Beloit, WI (US)

(73) Assignee: Troy Greenberg, South Beloit, IL (US)

( * ) Notice: Subject to any disclaimer, the term of this patent is extended or adjusted under 35 U.S.C. 154(b) by 0 days.

(21) Appl. No.: 15/274,311

(22) Filed: Sep. 23, 2016

Related U.S. Application Data

(60) Provisional application No. 62/232,846, filed on Sep. 25, 2015.

(51) Int. Cl.
*F16M 13/00* (2006.01)
*A47B 95/00* (2006.01)
*A47B 96/06* (2006.01)

(52) U.S. Cl.
CPC ..... *A47B 95/008* (2013.01); *A47B 96/06* (2013.01)

(58) Field of Classification Search
CPC ..... A47B 96/061; A47B 96/027; A47B 96/06; A47B 57/42
USPC ..... 248/220.22, 220.21, 225.11, 224.8, 235
See application file for complete search history.

(56) References Cited

U.S. PATENT DOCUMENTS

| | | | | |
|---|---|---|---|---|
| 6,119,878 | A * | 9/2000 | Zen | A47F 5/0846 211/57.1 |
| 8,167,258 | B1 * | 5/2012 | Wentworth | E04B 1/2403 248/214 |
| 9,399,873 | B2 * | 7/2016 | Hudson | E04D 13/106 |
| 9,456,692 | B2 * | 10/2016 | Tibbe | A47B 96/061 |
| 2002/0066840 | A1 * | 6/2002 | Servant | B60N 2/24 248/220.22 |
| 2002/0139912 | A1 * | 10/2002 | Shiojima | A47F 5/0838 248/220.21 |
| 2008/0197253 | A1 * | 8/2008 | Thompson | A47B 57/42 248/220.22 |
| 2014/0339019 | A1 * | 11/2014 | Hulett | E04G 3/20 182/113 |

* cited by examiner

*Primary Examiner* — Steven M Marsh
(74) *Attorney, Agent, or Firm* — Craige Thompson; Thompson Patent Law

(57) ABSTRACT

An attachment bracket or reinforcement plate is provided. The bracket is attached to an area of the respective product and provides an attachment location which is durable and maintains the structure of an inside corner of a cut in a melamine or wood product. In certain examples described herein, these storage systems may be held on a wall using a rail system. That is, a rail is attached to the wall which has an outward extending rail arm and upward extending flange. The flange engages with a notch or slot in the attachment bracket, which is secured to the melamine or wood product.

11 Claims, 6 Drawing Sheets

ATTACHMENT BRACKET

CROSS-REFERENCE TO RELATED APPLICATIONS

This application claims the benefit of U.S. Provisional Application Ser. No. 62/232,846, titled "Attachment Bracket," filed by Garrity et al., on Sep. 25, 2015. This application incorporates the entire contents of the foregoing application herein by reference.

FIELD

The present inventions relate to the field of cabinetry. The present inventions more specifically relate to the field of brackets and hardware for the hanging of cabinetry and other storage solutions.

BACKGROUND

Common materials used for cabinetry, desks, closets, fixtures, and furniture are wood and/or melamine. Unfortunately, when cut, these materials, while durable, are prone to crack, stress, or break at areas of weakness formed by the cut. In particular, a common area of weakness is an inside corner cut from the material.

Accordingly, a need exists in the art to maintain the structure of an inside corner of a cut in a melamine or wood product, such as a cabinet.

SUMMARY

An attachment bracket or reinforcement plate is provided. The bracket is attached to an area of the respective product and provides an attachment location which is durable and maintains the structure of an inside corner of a cut in a melamine or wood product. In certain examples described herein, these storage systems may be held on a wall using a rail system. That is, a rail is attached to the wall which has an outward extending rail arm and upward extending flange. The flange engages with a notch or slot in the attachment bracket, which is secured to the melamine or wood product.

These and other features and advantages of devices, systems, and methods according to this invention are described in, or are apparent from, the following detailed descriptions of various examples of embodiments.

BRIEF DESCRIPTION OF DRAWINGS

Various examples of embodiments of the systems, devices, and methods according to this invention will be described in detail, with reference to the following figures, wherein.

Figure 1:
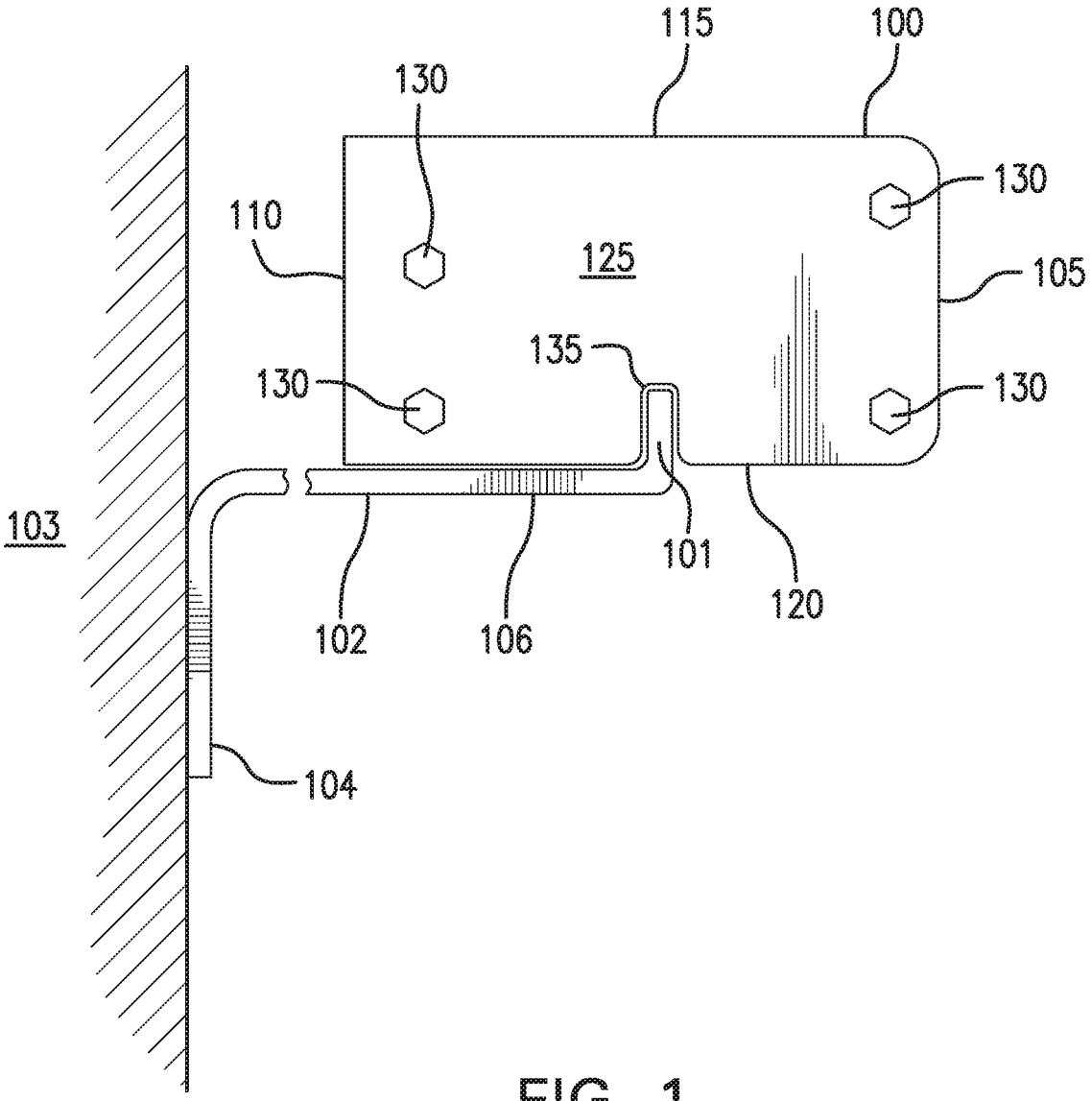
FIG. 1 illustrates one or more examples of an attachment bracket, and further shows a side view of a rail engaged with the attachment bracket.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Referring to the Figures, an attachment bracket or reinforcement plate 100 is provided. The terms "attachment bracket" and "reinforcement plate" are used interchangeably herein to refer to the same structure more fully described hereinbelow.

In one or more examples of embodiments, one or more cabinets, shelves, desks, closets, fixtures, furniture or other storage solutions 300 are provided. The respective storage solution 300 is cut so as to have a cut inside corner or slot. The attachment bracket is attached to an area of the respective product and provides an attachment location which is durable and maintains the structure of an inside corner of a cut or slot.

As described, one or more cabinets, shelves, desks, closets, fixtures, furniture or other storage solutions 300 may be formed of a melamine or wood material. This product 300 may be formed to include an inside corner or a slot which is cut from the melamine or wood material. For example, the melamine or wood product 300 as described herein is cut to form a notch or aperture 305 which receives a corresponding engaging component, such as for example, an upturned flange 101 of a longitudinal rail 102. In most embodiments, the aperture 305 is cut into the work piece with one or more squared corners forming one or more inside corners against which the component, e.g., the upturned flange 101 of the longitudinal rail 102, rests. The inside corner may further form the location of attachment of another component of the product, such as another wall, or attachment of another product.

It is known to provide cabinetry, shelves, desks, closets, fixtures, or other storage solutions 300 which hang from a wall. In some cabinet systems, the cabinets may hang by directly fastening to the wall with screws, bolts or the like. In other cabinet systems, the cabinet may be secured to the wall using a longitudinal rail.

Accordingly, in one or more examples of embodiments, one or more cabinets, shelves, or other storage solutions 300 are hung from a wall 103. These storage systems 300 may be held on a wall 103 using a rail system. More specifically, the rail system often includes or comprises the longitudinal rail 102 which is attached to the wall 103 (see FIG. 3). The rail 102 may be any suitable length and is formed of stainless steel or aluminum. The rail 102 has a wall attachment portion 104, with an outward extending rail arm 106 having the upturned end or flange 101 (see FIGS. 5,7, 8-9). The upturned end or flange 101 extends at an angle from the outward extending rail arm 106 of approximately 10 to 90 degrees. The flange engages with a notch or slot 305 in the cabinet wall, shelve or storage system or reinforcement plate 300 (see FIGS. 3 & 10).

Figure 2:
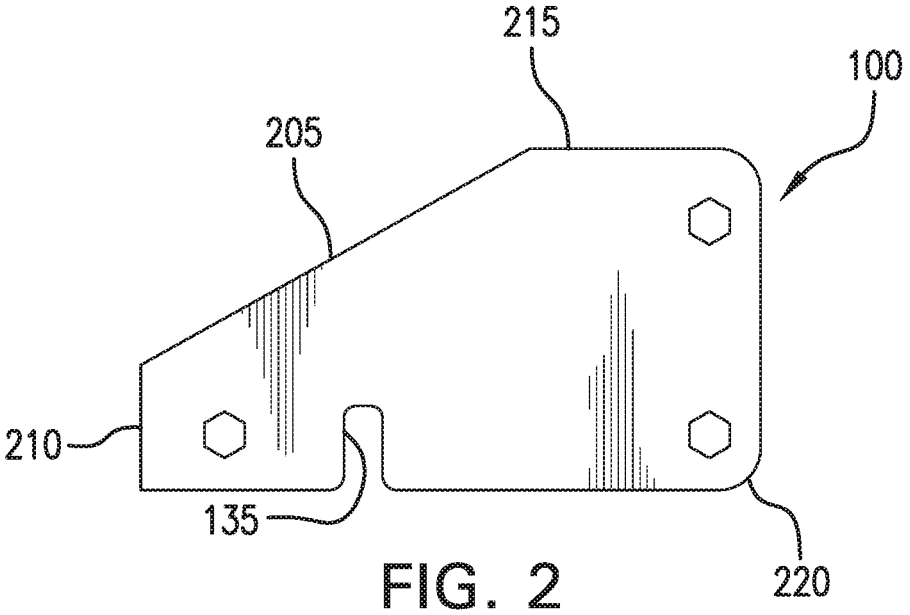
FIG. 2 illustrates one or more alternative examples of an attachment bracket.

According to one or more examples of embodiments, a bracket or reinforcement plate 100 is provided which mates with the rail 102, or alternatively mates with a corresponding component of a storage solution to be attached. The bracket has a first side edge 105, a second side edge 110, a top edge 115 and a bottom edge 120. In the illustrated embodiment shown in FIG. 1, two pairs of edges 110 and 115 are parallel to each other and adjacent edges 115 and 120 are perpendicular, although variations may also be acceptable. In this regard, the bracket 100 may be substantially rectangular. Alternatively, the bracket 100 may further include an inclined or angled edge wall 205 extending between a side edge 210 and a top edge 215 as shown in FIG. 2, which may be more suitable for certain applications and also provides the benefit of a reduction in material. Other configurations are also suitable for the purposes provided. For example, one or more inclined edges 205 may be added at any connection between intersecting walls, forming a number of polygonal shapes, or one or more walls may be rounded. As shown in the Figures, one or more corners 220 of the bracket may be rounded or smoothed.

The bracket 100 is formed of a durable, strong, and substantially rigid material. For example, the bracket 100 may be formed of steel or aluminum, or other alloys. Alternatively, it is contemplated that the bracket 100 may be formed or at least partially composed of a composite material or a plastic.

The bracket 100 also has a first face 125 and a second face (not shown) and includes a plurality of apertures or openings 130 for receipt of a fastener. In one or more examples of embodiments, three or four apertures 130 are provided, although variations thereon may be acceptable for the purposes provided. The apertures 130 may be offset as shown in FIG. 1. Alternatively, the apertures 130 (and fasteners) may be evenly distributed across the bracket 100 or may be distributed around a perimeter or portion of the perimeter of the bracket 100.

The bracket may also include a slot or receptor 135 for receipt of, for example, a portion of the mating rail 102 or other mating component (FIG. 1). In one or more preferred examples of embodiments, the slot 135 is positioned in the bottom edge 120 of the bracket 100 between the first and second side edges 105 and 110. The slot 135 may extend upward, perpendicular to the bottom edge 120. Alternatively, the slot 135 may be angled greater or less than 90 degrees from the bottom edge 120. Preferably, when used with the longitudinal rail 102, the slot 135 is angled to receive a corresponding upturned end or flange 101 from the rail 102. The slot 135 extends upward a distance into the body of the bracket 100. Preferably, the slot 135 is sized to receive a corresponding shaped flange 101 or a portion thereof (see, e.g., FIG. 1).

Additional examples of the attachment bracket or reinforcement plate 100 and corresponding rail or longitudinal rail 102 are shown in FIGS. 4-10. Shown in these Figures are a 90 degree reinforcement plate or bracket 400 and corresponding rail 500, as well as an angled reinforcement plate or bracket 600 and corresponding rail 700.

As one specific example of the bracket 100 suitable for the purposes provided, the bracket 100 may be approximately 3.7165 inches in length by approximately 2.0000 inches in height. In the preferred example described herein, the slot 135 is spaced approximately 1.8445 inches from the first side edge 105 and approximately 1.6850 inches from the second side edge 110. The slot 135 may also be approximately 0.1870 inches in width. While a specific example is illustrated, alternatives may also be acceptable.

Figure 3:
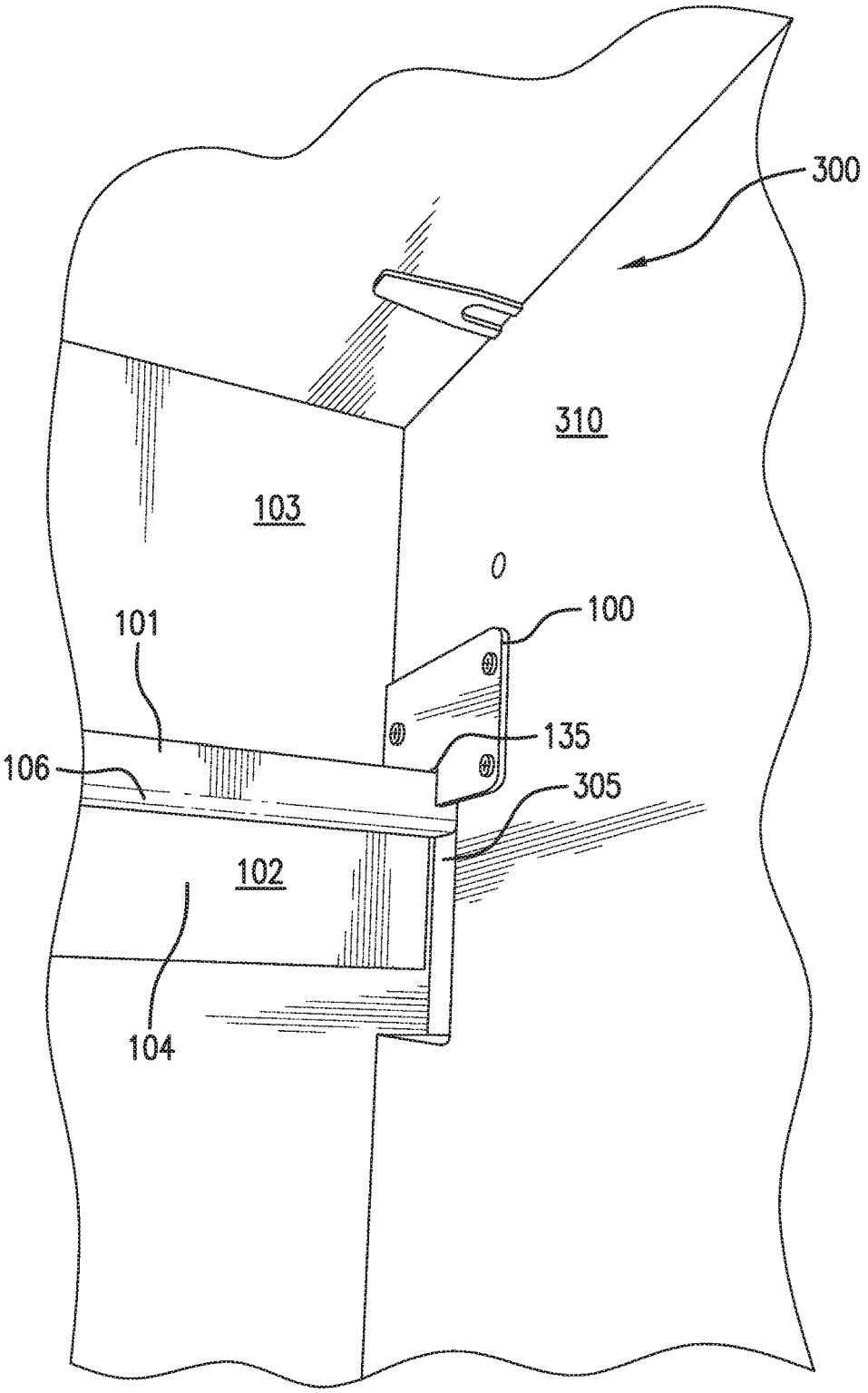
FIG. 3 illustrates an attachment bracket in use with a storage solution.
Figure 4:
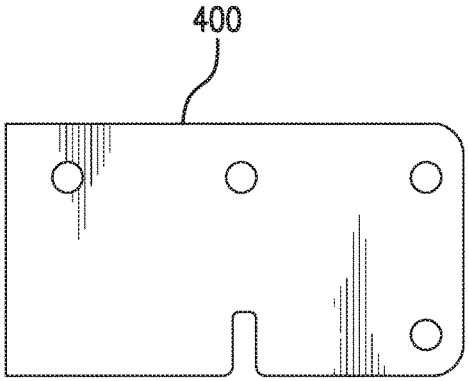
FIG. 4 illustrates a plan view of an attachment bracket or reinforcement plate with a 90 degree slot for engaging a rail.
Figure 5:
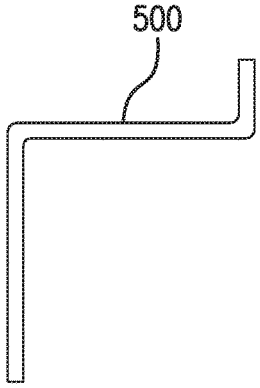
FIG. 5 illustrates an end elevation view of a longitudinal rail having a flange extending at 90 degrees to mate with the attachment bracket or reinforcement plate shown in FIG. 4.
Figure 6:
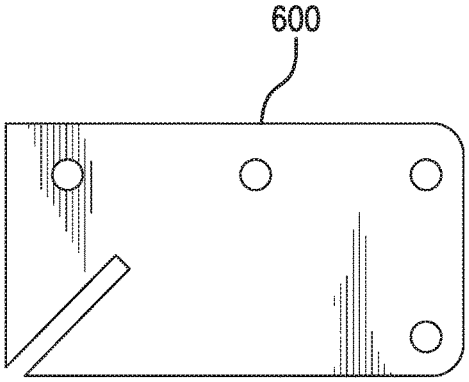
FIG. 6 illustrates a plan view of an alternative attachment bracket or reinforcement plate with an angled slot for engaging a rail.
Figure 7:
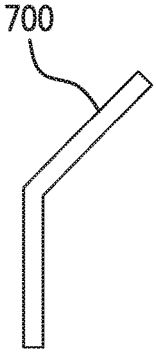
FIG. 7 illustrates an end elevation view of a longitudinal rail having a flange extending at an angle to mate with the attachment bracket or reinforcement plate shown in FIG. 6.
Figure 8:
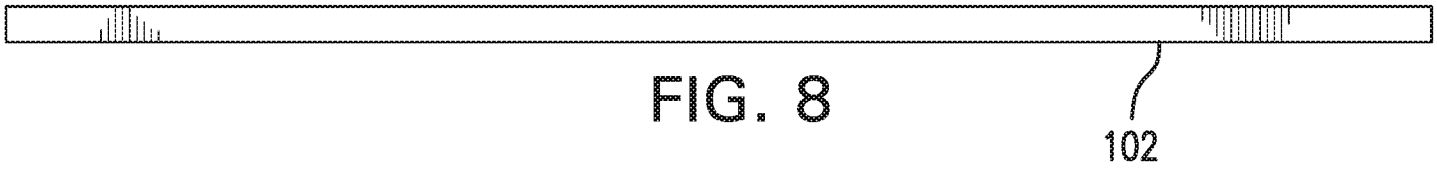
FIG. 8 illustrates a top plan view of a longitudinal rail.
Figure 9:
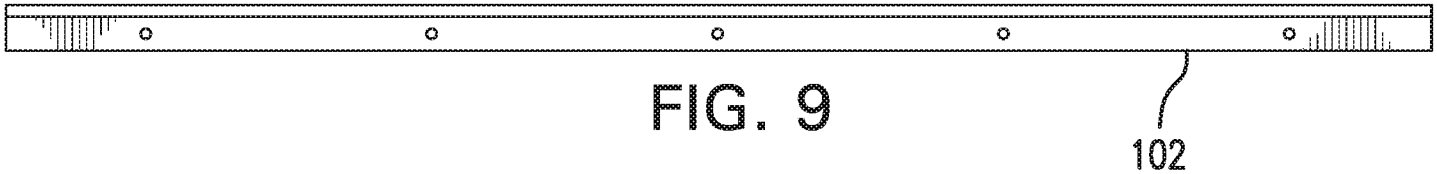
FIG. 9 illustrates a front elevation view of a longitudinal rail.
Figure 10:
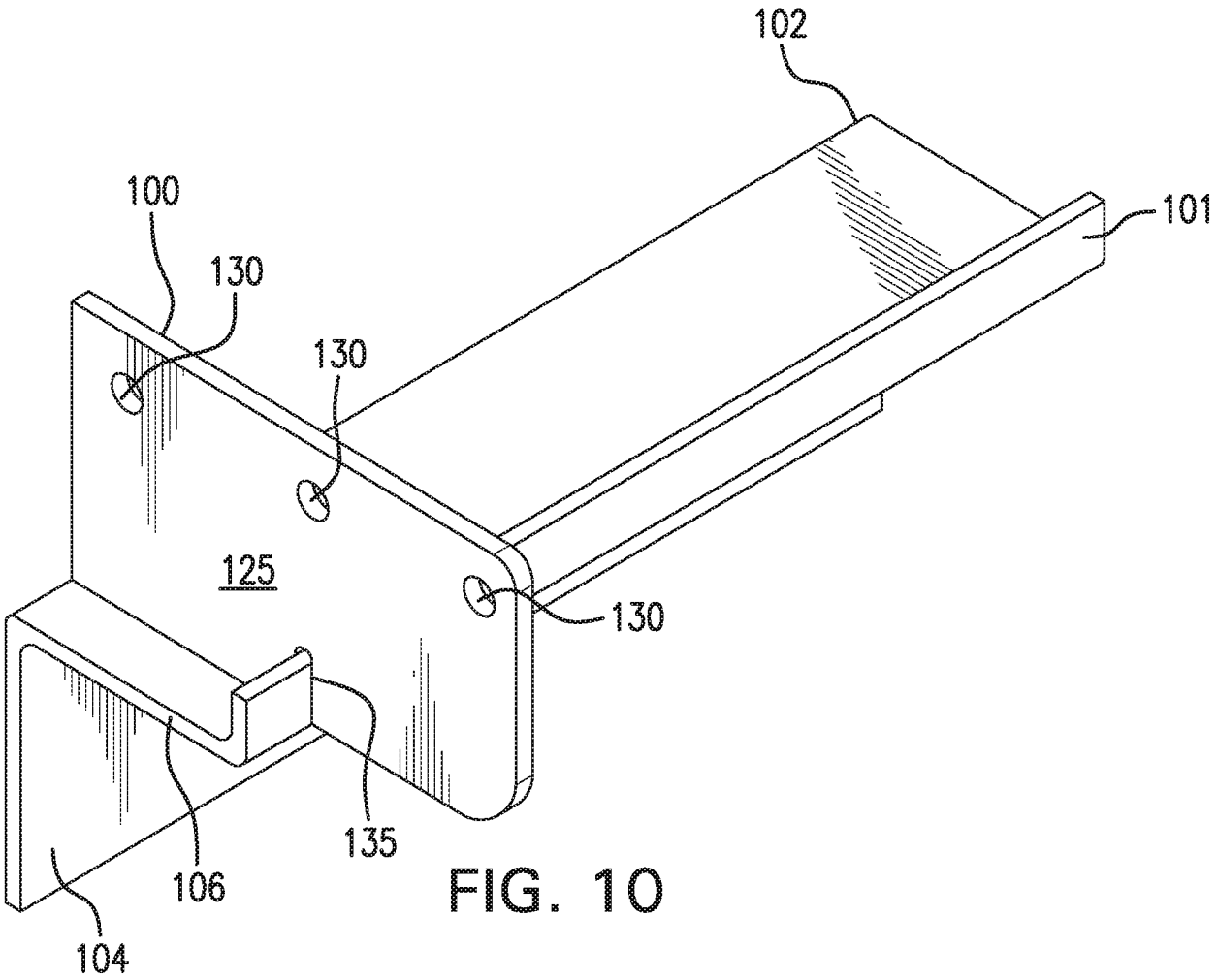
FIG. 10 illustrates a perspective view of the attachment bracket or reinforcement plate of FIG. 4 engaged with the longitudinal rail of FIG. 5.

As indicated, the bracket 100 engages the mating flange 101 (see FIGS. 3 and 10). This is accomplished by positioning the bracket or reinforcement plate 100 at the inside corner or slot 305 of a wood or melamine product 300. Fasteners extend through the apertures 130 in the bracket 100 and into a wall or surface 310 of the melamine or wood product, thereby securing the bracket 100 to the melamine or wood product 300. Alternative means of fastening, now known or future developed, may also be used in place of the fasteners specifically described herein.

In one example illustrating operation of the bracket 100, the rail 102 is provided which is attached to the wall 103 at the desired location and one or more brackets 100 are attached to walls 310 of a cabinet 300 at inside cut corners or slots 305 of the cabinet 300. More specifically, the brackets 100 are attached to the wall or walls 310 of the wood or melamine product 300, which when secured to a structure, extend perpendicular to the structure. The bracket(s) 100 is/are attached by aligning the bracket 100 in the desired position such that the slot 135 is on the bottom edge 120 and extends approximately upward. Fasteners are inserted through the bracket apertures 130 into the cabinet wall 310. The cabinet 300 is then lifted into position and the slot 135 on the bracket(s) 100 is/are aligned with the upturned end or flange 101 of the rail 102 and mated and rested thereon, thereby retaining the cabinet 300 on the rail 102.

The attachment bracket 100 herein provides various advantages over existing systems. For example, in existing systems, the common materials used for cabinetry, desks, closets, fixtures, and furniture are wood and/or melamine which are prone to crack, stress, or break at areas of weakness formed by a cut. The attachment bracket described herein provides an attachment location which is durable and maintains the structure and strength of an inside corner of a cut in a melamine or wood product. This provides particular advantages when the storage system is held on a wall using a rail system having a flange engages with a notch or slot in the attachment bracket which is secured to the melamine or wood product.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g., by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting.

Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

What is claimed is:

1. An attachment bracket system comprising:

a rail member extending longitudinally having a mount portion surface mountable to a vertical wall surface and a flange portion extending in an upward direction;

a vertical wall member adapted to mount to the rail in a vertical plane extending from a back edge proximate to the vertical wall surface to a front edge, wherein the back edge defines a cut-out region having a greater distance of separation from the vertical wall surface than the portions of the back edge that are above and below the cut-out portion; and, a rigid bracket configured to attach to the vertical wall member spanning an upper portion of the cut-out region, a bottom edge of the bracket defining a notch configured to receive the flange portion of the rail member.

2. The attachment bracket system of claim 1, wherein the rigid bracket further comprises a plurality of apertures adapted to receive a plurality of corresponding fasteners for attaching the rigid bracket to the vertical wall member.

3. The attachment bracket system of claim 1, wherein the notch in the rigid bracket is vertical with respect to the bottom edge of the rigid bracket.

4. The attachment bracket system of claim 3, wherein the rail member further comprises a rail arm portion extending horizontally from the mount portion to the flange portion, and wherein the flange portion extends from the rail arm portion.

5. The attachment bracket system of claim 4, wherein the flange portion of the rail member extends vertically upward, and at a substantially 90 degree angle, from the rail arm portion.

6. The attachment bracket system of claim 1, wherein the notch in the rigid bracket is at an acute angle with respect to the bottom edge of the rigid bracket.

7. The attachment bracket system of claim 6, wherein the flange portion of the rail member extends at an obtuse angle from the mount portion.

8. The attachment bracket system of claim 1, wherein at least one of the corners of the rigid bracket is substantially smoothed.

9. The attachment bracket system of claim 1, wherein the rigid bracket has at least five edges, and wherein a first pair of edges are parallel to one another, a second pair of edges are parallel to one another and perpendicular to the first pair of edges, and an angled edge extends between one of the first pair of edges and one of the second pair of edges.

10. The attachment bracket system of claim 1, wherein the rigid bracket is formed from a material selected from the group consisting of steel, aluminum, metal alloy, or plastic.

11. The attachment bracket system of claim 1, wherein the rail member is formed from a material selected from the group consisting of stainless steel and aluminum.

* * * * *